United States Patent [19]

Ebert

[11] 4,215,814

[45] Aug. 5, 1980

[54] FLUE GAS TRAP AND DIVERTER

[76] Inventor: Edward A. Ebert, 203 Huxley Dr., Snyder, N.Y. 14226

[21] Appl. No.: 866,458

[22] Filed: Jan. 3, 1978

[51] Int. Cl.[3] ..... F23J 11/02

[52] U.S. Cl. ..... 236/1 G; 126/307 R; 126/307 A; 165/DIG. 2

[58] Field of Search ..... 236/16; 126/307 R, 307 A, 126/312, 373, 110 R, 116 R, 299 R; 237/55, 50; 165/DIG. 2, DIG. 12, 154, 137; 98/48, 46, 58, 66 R; 137/269; 285/9 R, 122, 134

[56] References Cited

U.S. PATENT DOCUMENTS

| | | | |
|---|---|---|---|
| 739,076 | 12/1902 | Grondahl | 126/299 |
| 1,837,581 | 12/1931 | Peterson | 126/312 |
| 2,180,212 | 11/1939 | Morrow | 126/307 A |
| 2,651,299 | 9/1953 | Brown | 126/307 A |
| 3,934,798 | 1/1976 | Goldsmith | 165/DIG. 2 |
| 4,009,705 | 3/1977 | Smith | 126/307 A |
| 4,082,142 | 4/1978 | Blackburn et al. | 165/137 |

FOREIGN PATENT DOCUMENTS

| | | | |
|---|---|---|---|
| 1281313 | 11/1960 | France | 126/307 A |

*Primary Examiner*—Albert J. Makay
*Assistant Examiner*—Henry Bennett

[57] ABSTRACT

An energy conserving device for preventing loss of heat energy from a heater to a chimney by means of a fluid gas heat trap to choke off either chimney draft and/or heated convectional air currents lost to the chimney when the heater is OFF but allowing combustion gasses to vent freely to the chimney when such gasses are generated. The device also acts as a diverter for either up or down drafts from the chimney to direct them away from the heater. In another form when the device is used with a forced air type furnace, the device in addition provides heat interchange between room air and the hot gasses in the trap. This then heated air is drawn into the circulating system of the furnace adding to its temperature while lowering the temperature of the vented combustion gasses, to lessen the heat loss up the chimney.

9 Claims, 13 Drawing Figures

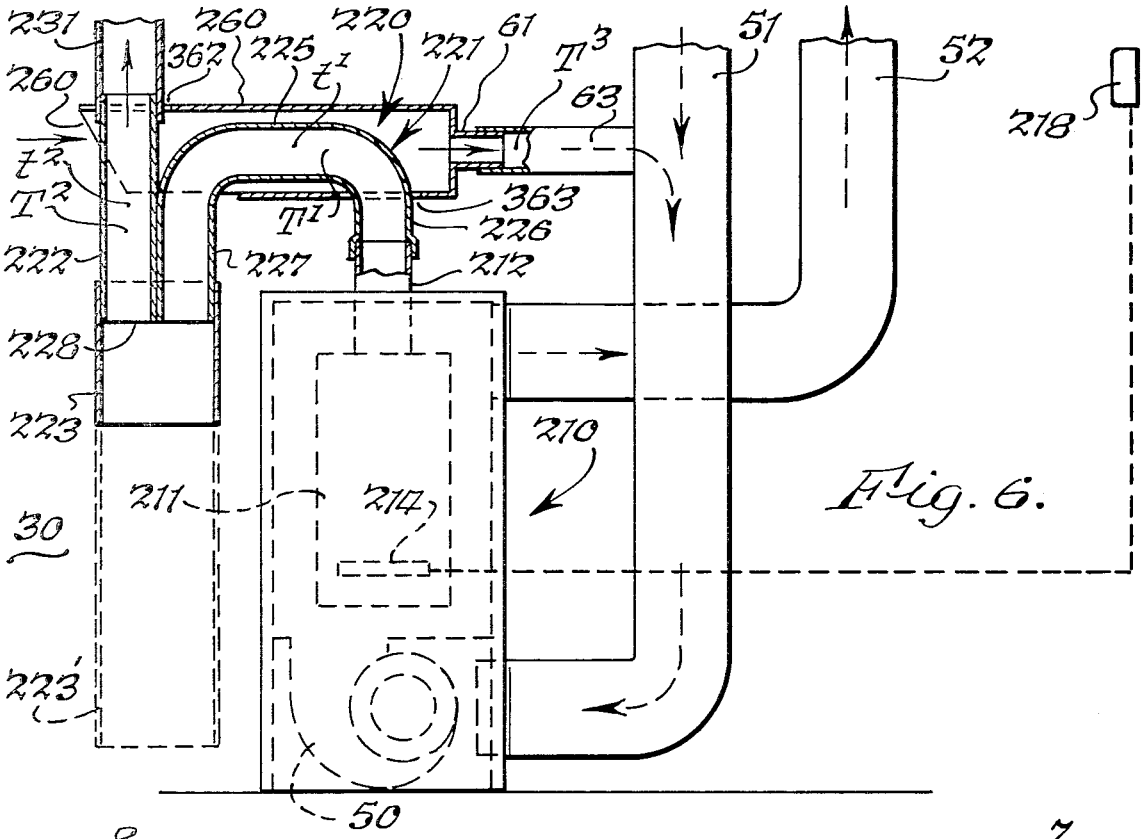
Fig. 6.
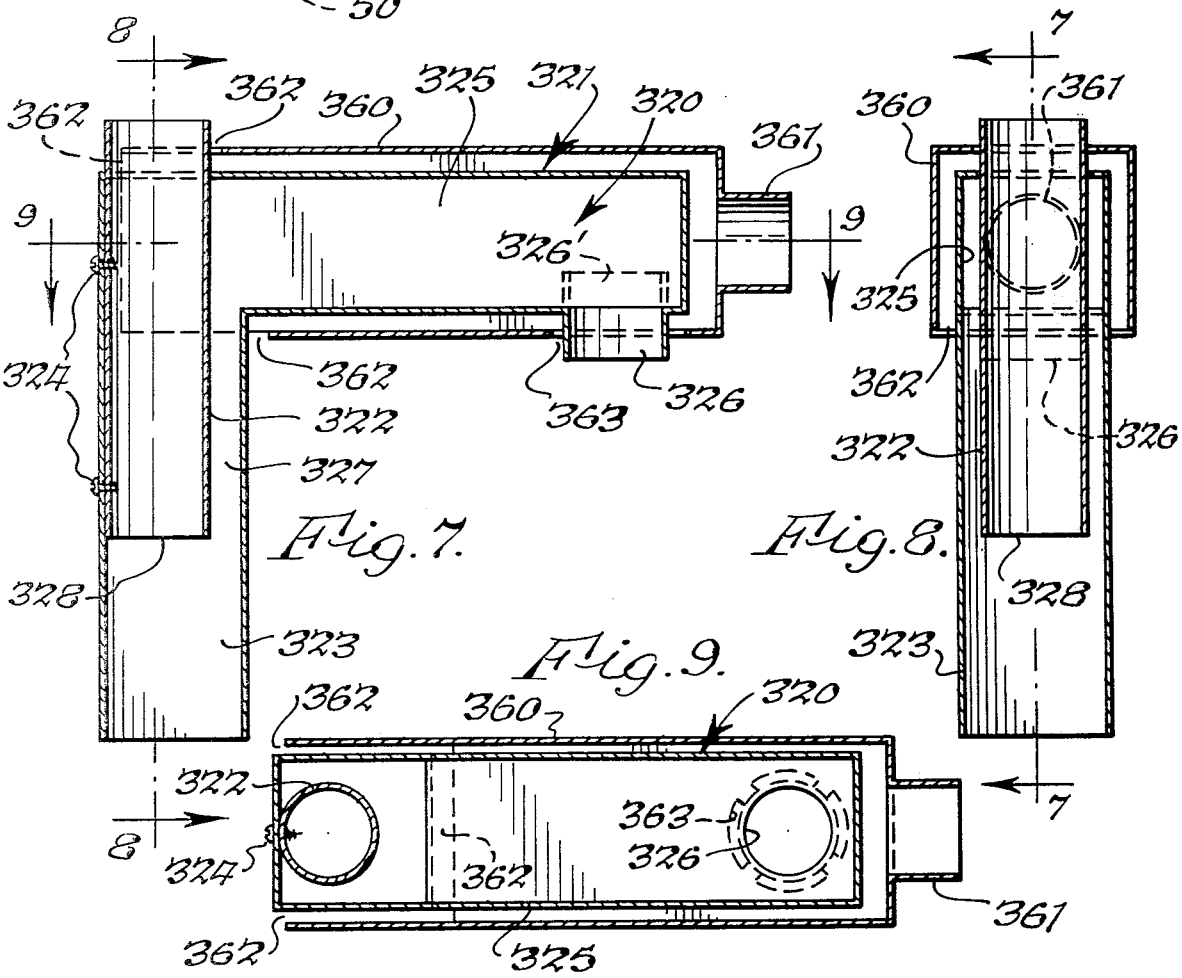

FLUE GAS TRAP AND DIVERTER

BACKGROUND OF THE INVENTION

This invention relates to a heat energy conservation device for use with heating equipment, wherein the heater is ON and doing its heating and then again is OFF because it has done its work. In either case heat loss occurs and it is the minimizing of this heat loss that this invention is directed to. The term heater used herein includes furnaces, hot water boilers, hot water tanks and heating apparatus of various types using gas, oil and other fuels requiring connection to a chimney.

More particularly the present invention relates to a choke in the form of an inverted U, V or L combined with the flue of the heater to form a fluid trap. This trap employed between the flue of the heater and the chimney chokes off hot air emanating from its heat interchange surfaces while in an OFF or non-heating mode to eliminate this large loss of heat energy. Heaters such as these by their very nature and design are both heat absorbers as well as heat exchangers. Their nature does not change when they are changed from an OFF mode where their burner is OFF to an ON mode where their burner is ON or vice versa. They still act as heat exchangers and thereby promptly lose the heat they had gained to return to the ambient temperature of their environment.

One problem with the present flue connections used, which in many cases are mandatory by local laws, is the inclusion of a draft deflector or diverter usually placed at the top of the heater and then piped to the chimney. By virtue of its location, at the top of the heater, it is constantly taking away heated air, lost from heating areas of the heater and also warm room air and delivering it to the chimney and out of the living space, a complete loss and waste of this heat energy. Also by being located at the top of the heater it is drawing room air from a stratum of, warmer than average room air.

The present invention uses the principle of a deflector or so-called draft diverter, to take advantage of its usefulness and compliance to the safety laws but places it to a side of the heater where it can take air from a lower stratum and at a lower temperature, to reduce the thermal loss when evacuating room air. Of greater importance is the fact that the present invention further chokes off the lost hot air of the appliance to slow down the reverse heat transfer of its heating surfaces when the burner is OFF but yet does not impede the flow of hot combustion gasses through to the chimney when the burner is ON. The choking off of hot gasses also gradually lowers the chimney temperature and this then in turn lowers its motivation to draw as strongly as when hotter.

A principle object of this invention is to provide an energy saving attachment for heaters to increase their efficiency. To provide a choke or valve effect between a heater flue and a chimney and which allows free flow of hot gasses through it to the chimney while the heater is ON but which chokes off or checks the flow of hot gasses through it to the chimney when the heater changes to ON to assist in retaining residual heat energy.

Another object is to provide a choke with a diverting or deflecting capability to prevent down or up drafts from the chimney entering the flue of the heater.

A further object is to provide a choke or valve which acts as a heat exchanger to reclaim heat energy from exhaust flue gasses and return that energy back into the heating system.

Still another object is the provision of a choke which is adjustable in its choking effect to fit its degree of choking to the heater that it is used with.

One further object is to provide a choke without moving parts which changes its effect to allow either free flow or the choking of gasses through it.

Another object is to provide a choke responsive to the natural law of gravity using the stratification of heated gas strata, to either restrict, or allow free flow of gasses, through it, a change from one to the other being triggered by the control thermostat of the heater, furnace or other heating apparatus, turning the burner ON.

SUMMARY

This invention provides a means to prevent heat loss from a heating apparatus which has residual or stored heat energy. When the heater is hot, with its burner OFF, the means which comprises an inverted V, U, or L shaped trap, chokes off the passive flow of hot gas through it by the stratification of heated gasses due to their gravitational response to the natural low of gravity. This same means when the burner is ON allows a free flow of high temperature combustion gasses at high volume to the chimney because of the turbulence of these hot gasses neutralizing their stratification, plus their higher motivity, materially changing the choking effect.

BRIEF DESCRIPTION OF THE DRAWINGS

The present invention, as well as further objects and features thereof, will be understood more clearly and fully from the following detailed description of the preferred embodiment, when read in conjunction with the accompanying drawings, in which:

FIG. 6 is a diagrammatic showing of a modified form of the invention suitable for use with a house heating furnace having a forced air system;

FIG. 7 is a vertical central section of a further modified construction taken along line 7—7 of FIG. 8;

FIG. 8 is a vertical section taken at ninety degrees along line 8—8 of FIG. 7;

FIG. 9 is a horizontal section taken along line 9—9 of FIG. 7;

GENERAL OPERATION

Figures 1, 2, 3, 4, 5:
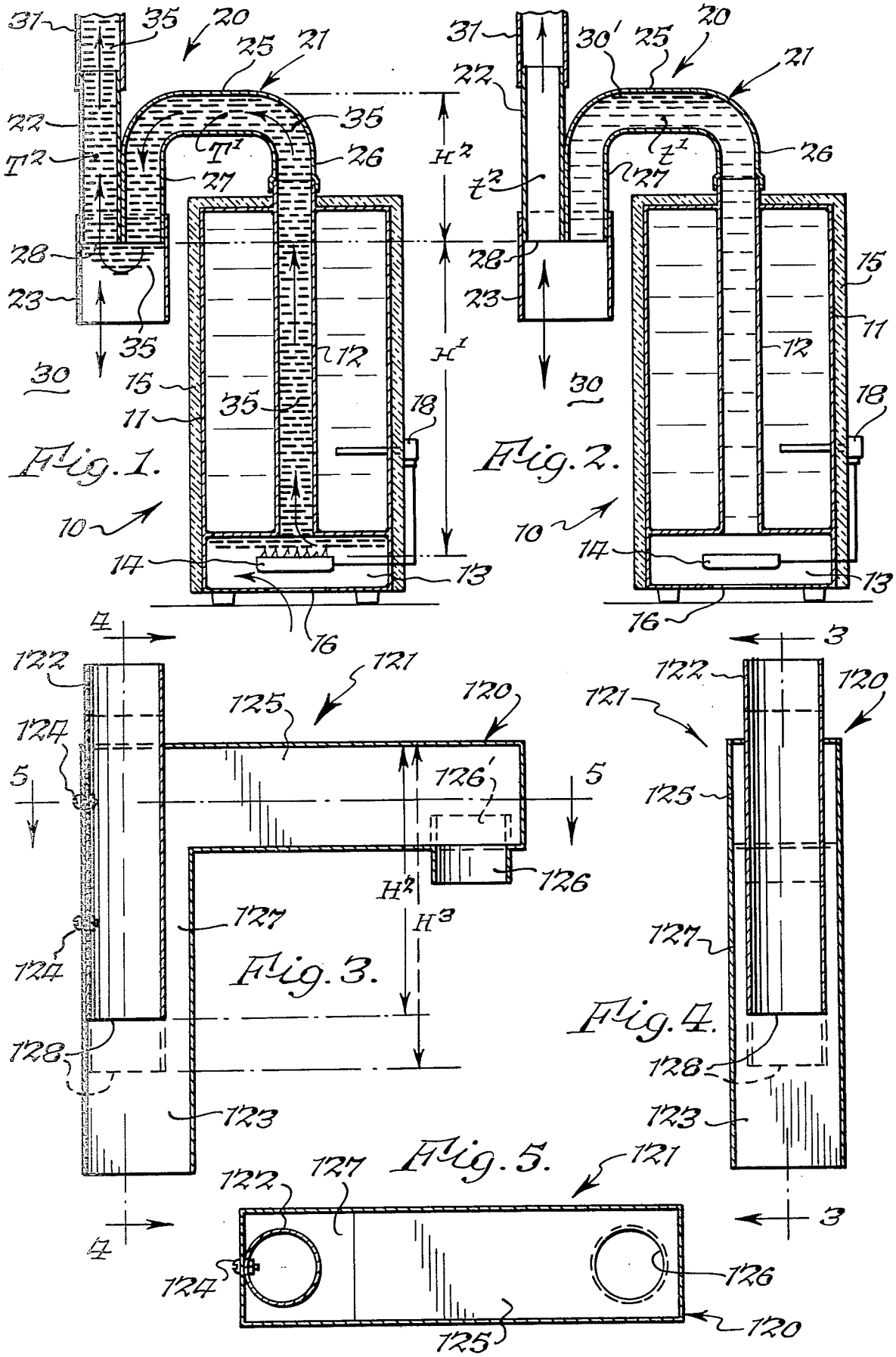
FIG. 1 is a diagrammatic vertical sectional view taken through the center of a typical hot water heater shown in ON or heating mode.
FIG. 2 is a similar diagrammatic sectional view shown in OFF with stratification of hot gasses choking off flow through the trap.
FIG. 3 is a vertical central sectional view of a trap, taken along line 3—3 of FIG. 4.
FIG. 4 is another vertical section taken at ninety degrees to that of FIG. 3 and along line 4—4 of FIG. 3.
FIG. 5 is a horizontal section taken along line 5—5 of FIG. 3.

In FIGS. 1 and 2 of the drawings, use, has been made of the graphical symbol of "liquid" to represent not only the water in the hot water heater shown, but also to represent the fluid hot combustion gasses as well as the fluid hot air, in the flues, the pipes and the chimney.

As shown in FIGS. 1 and 2 a hot water storage tank is shown having a tank proper 11 with a flue 12, a burner chamber 13, a burner 14, an insulating jacket 15 and a secondary combustion air inlet 16.

At the upper end of the flue 12, a combined hot gas trap and draft deflector or diverter 20 is fitted. This assembly 20 is essentially comprised of an inverted U-shaped part 21, a chimney connection 22 and a shroud part 23. The inverted U-shaped part 21 is comprised of a horizontal leg duct part 25 joined to the upper ends of a downwardly extending first vertical duct or heater connection 26 and the upper end of another downwardly extending second vertical duct or vertical chimney leg 27. The lower end of duct 26 is fitted to the upper end of the tank flue 12 with a gas tight fit while the lower end of duct 27 fits into the upper end of the shroud part 23, with the lower end 28 of the chimney connection duct 22, the shroud part 23 having its lower end extending downwardly and open to the room space 30.

At the junction of chimney connection 22, the chimney leg 27 and the shroud 23 a gas tight fit is provided so that hot flue gas will be directed to the chimney 31 rather than into the room space 30, since out coming hot gas from duct 27 will turn about an rise by gravity into the duct 22 and then flow to the chimney 31.

The use of the term U-shape is not intended to be a limitation but as an aid to description since an inverted V-shape or L-shape could also be used as descriptive terms. Use of the term heater is intended to include any heating apparatus having a burner that requires venting, which is ON for a period of time and then is OFF for a period of time. Also all temperatures indicated are the Fahrenheit scale.

In FIG. 1 the burner 14 is shown as ON, producing high temperature combustion gasses 35, as indicated by the heavy fluid horizontal dash lines, by the burning of a fuel gas and primary air mixture supplied to the burner 14. The gas supply, not shown, is supplied in the usual manner while secondary air enters the burner chamber through the air inlet 16.

As is usual but not shown in detail, a thermostat 18 controls the temperature of the heated water in the tank 11 by turning ON and OFF the fuel gas supply. As shown hot and turbulent combustion gasses 35 flow upwardly in the flue 12 into the flue connection 26, the horizontal leg or duct 25 and chimney leg duct 27 downwardly into the shroud 23 and then up into the chimney connection 22 to the chimney 31. All of this upward and outward progression of flow is induced by the force of gravity since heated gas is lighter and more buoyant than the ambient temperature room air. As these high temperature combustion gasses rise in the flue 12, they are usually agitated by baffles (not shown) to cause good transfer of heat from the hot gasses through the walls of the flue 12 to the surrounding water. The bottom tank wall also transfers heat from the burner flames to the water.

In FIG. 1 the heavy and dense dash lines are used to illustrate the fast flowing, turbulent combustion gasses originate at the lowest point, at the burner and fill all passages up to the chimney 31. These combustion gasses have a high temperature of several hundred degrees usually around 700–1000 degrees Fahrenheit, very much above the actual temperature of the heat exchange walls of the tank 11. These hot gasses are moving at such a high rate of speed and are so turbulent that they cannot stratify into layers or strata of different temperatures and hence freely flow up through the flue 12, trap 20, shroud 23 chimney connection 22 to the chimney always motivated to rise because of lightness and pressure behind them, caused by the high temperature source, the burner.

In FIG. 2, where the burner 14 has been shut OFF by thermostat 18 because the water in the tank has reached the set temperature, the liquid dash lines representation is shown as light and spaced except where stratification has taken place, in the upper portion of the trap 20. Here stratification occurs because the only gasses 30' collecting in the trap 20 are from warmed room air 30, which entered through the secondary air inlet 16 and was warmed by the reverse heat transfer of the hot water, tank 11 bottom and flue wall 12 and consequently has risen up into the trap 20. The temperature of the tank walls being around 150° quite a few hundred degrees lower than the afore mentioned high temperature combustion gasses and flames, these gasses rise much more slowly and are not forced.

After these lower temperature gasses slow down the flow, gradually they become quiescent and latent and stratification begins to occur. When it does a choking off of the flow through the trap 20 takes place. The hottest, lightest gasses lie uppermost in the duct 25 and resist downward movement. Consequently cooler and cooler gasses lie in strata, one below the other in the trap 20, in the horizontal leg 25 and both the flue connection 26 and the chimney leg 27. This choking then causes a further slowing down of the flow of room air 30 through the flue 12, a further slowing down of reverse heat transfer and also heat lost to this air until stagnation occurs with the flow substantially stopped. With the reverse heat transfer greatly reduced, warm air flow to the chimney now causes a lack of thermal activation the chimney requires and hence it loses its capability to function as actively as when heated. The heater now practically isolated from heat loss encouraged by the chimney can only lose heat to the room space it is in, thus conserving heat energy.

The temperature gradient of the hot gasses in FIG. 1, when the heater is ON would be approximately 850° near the burner 14 to approximately 450° in the trap 20, a difference of about 400°. In FIG. 2, when the heater is OFF the temperature gradient would be approximately 65° at the secondary air inlet 16 to approximately 100° at the top of the trap 20, an inverted difference of about 35°.

It should be noted that the apparatus of FIG. 1 the highest temperature will be at the bottom of the flue 12, while in the apparatus in FIG. 2 the highest temperature will be at the top in the trap 20. This difference causes high motivation of gas flow in the ON condition but lower motivation of gas flow in the OFF condition.

The head or pressure of the hot combustion gas can be measured by its height and its temperature and in FIG. 1 is indicated as $H^1$. That portion indicated as $H^2$ represents the inverted heat trap assembly 20, where we have the $H^2$ head cancelled out by the down flow portion of duct 27.

It should be observed that the trap assembly 20 is unrestricted and unhindered by any moving parts such as those of a mechanical valve. Any up or down drafts created by wind or other causes are either vented or deflected into the room space by the chimney connection 22 and shroud 23, while shielding the heating applicance from any of these drafts. These drafts cannot appreciably cause the drawing of heated air from the heater or snuff out its pilot flame.

In summary then it can be said that when the trap is confronted with a fast flow of combustion gasses at high temperature and large volume it freely passes these gasses. But contrarily, when the trap 20 confronts a slow flow of relatively low temperature air or gas, in small volume it will allow and aid in the stratification of these gasses in strata or layers, the higher temperature gasses in the top and the lower temperature gasses in the bottom, to stifle and choke off the flow of gasses through the trap.

DETAILED DESCRIPTION

In the Figures of 3, 4 and 5 a construction of the invention is illustrated wherein all parts similar to those just described in FIGS. 1 and 2 have similar numbers with the prefix 1. In this form the hot gas trap 120 having an inverted L-shaped part 121 has a heater flue connection 126, or 126' a horizontal leg 125 and a vertical chimney leg 127. The L-shaped part 121 as well as the leg 127 are of rectangular (which may be either downstanding 126 or upstanding 126') shape. The flue connection 1, is cylindrical in shape, as is a chimney connection 122. The chimney connection duct 122 is assembled inside of the chimney leg duct 127 and terminates at 128 short of the terminal end of the chimney leg 127, thus that part of the chimney leg 127 extending below the lower end 128 of duct 122 become a shroud portion 123, equivalent to the shroud part 23 shown in FIGS. 1 and 2.

By virtue of the fact that duct 122 is mounted inside of the leg 127 it may be raised or lowered relative to the leg 127 by its fastenings 124 to cause its lower end 128 to change the height of the head $H^2$ to $H^3$, as seen in FIG. 3. By the lowering of end 128 from the position of $H^2$ to $H^3$ the head $H^2$ as seen in FIG. 1 is increased, to increase the choke effect of the trap 121, while at the same time the head of $H^1$ is reduced. By raising the end 128, the reverse is true, i.e., $H^2$ would be decreased and $H^1$ would be increased. Thus, this trap 121 can be matched to the heater it is used with, to obtain optimum performance and maximum retention of heat within the heater.

In the forms of the invention just described in FIGS. 1–5 it must be clear that the trap assemblies 21 and 121 inherently have a heat transfer taking place, i.e., heat transfer between the hot combustion gasses inside of them with the outside surrounding space air 30. This heat might or might not be desirable in this space 30, it might be more desirable, or more useful in some upper rooms of the home or establishment. To take advantage of this need another form of the invention will be described.

A trap illustrated in FIG. 6 shows in diagrammatic form a forced air furnace 210 such as that used in many homes today. In this form of the invention all numbers of similar parts thus far described, will bear the prefix 2.

A heat interchanger 211 having a burner 214 and a flue 212 heat the air in the furnace enclosure 210, while a blower 50 circulates the warmed air throughout the home via a cold air return 51 and a warm air distribution duct system 52. A thermostat 218 controls the ON-OFF cycling of the furnace 210 to maintain a set temperature in the home.

The hot gas trap and deflector assembly 220 is essentially the same as 20 shown in FIGS. 1 and 2 but is enclosed by a housing 260. This housing 260 has one of its ends open to the room space 30 and another of its ends terminating in a pipe connection 61 which may be connected to the cold air return 51 of the furnace 210 by a pipe 63.

In this construction the operation is essentially the same as has been described for FIGS. 1–5 with the exception that when the furnace 210 is in operation with the burner 214 ON and the furnace blower 60 running, low air pressure in the air return 51 causes ambient air from the room space 30 to be drawn into the open end of 260 and over the parts 222, 227, 225 and 226 all of which constitute the U-shaped part 221. At this time all of these parts have hot combustion gasses inside of them flowing from the furnace flue 212 to the duct 222 and chimney 231 so that heat transfer between the hot combustion gasses and the ambient air takes place. This heated air is drawn through pipe connections 61 and 63 into the air return 51 of the furnace circulating system where it is heated further by the furnace and then distributed to places where heat is wanted.

Thus this hot gas trap and diverter or deflector in effect becomes not only a choke to prevent unnecessary loss of heat energy but also enhances the heat interchange of the furnace 210 to heat the air in the place it is used in.

In FIGS. 7, 8 and 9 is shown a modified construction of that just described in FIG. 6. Similar parts have numbers with the prefix 3.

A housing 360 encloses a gas trap 320 which comprises a U-shaped assembly 321 having horizontal leg 325, a heater flue connection 326, and a vertical chimney leg 327. The housing 360 surrounds a portion of duct 327, all of duct 325, part of duct 326, has an open end 362 and a pipe connection 361. The chimney connection 322 which connects with a chimney is mounted adjustably inside of the chimney leg 327 by fasteners 324 in the same manner and for the same reason, vertical adjustment, as in the form shown in FIGS. 3, 4 and 5. The open end 362 and openings at 363, at duct 327 and duct 326 allow ambient air of the room space 30 to be drawn in as well as heated air lost by the walls of the heater when used with a furnace 210 as illustrated in FIG. 6.

As indicated in dotted lines in FIG. 7, the heater flue connection 326 may in some uses be reversed into the upstanding configuration of 326' where vertical head room must be conserved. This then makes the U-shaped assembly 321 more nearly L-shaped.

Figure 10:
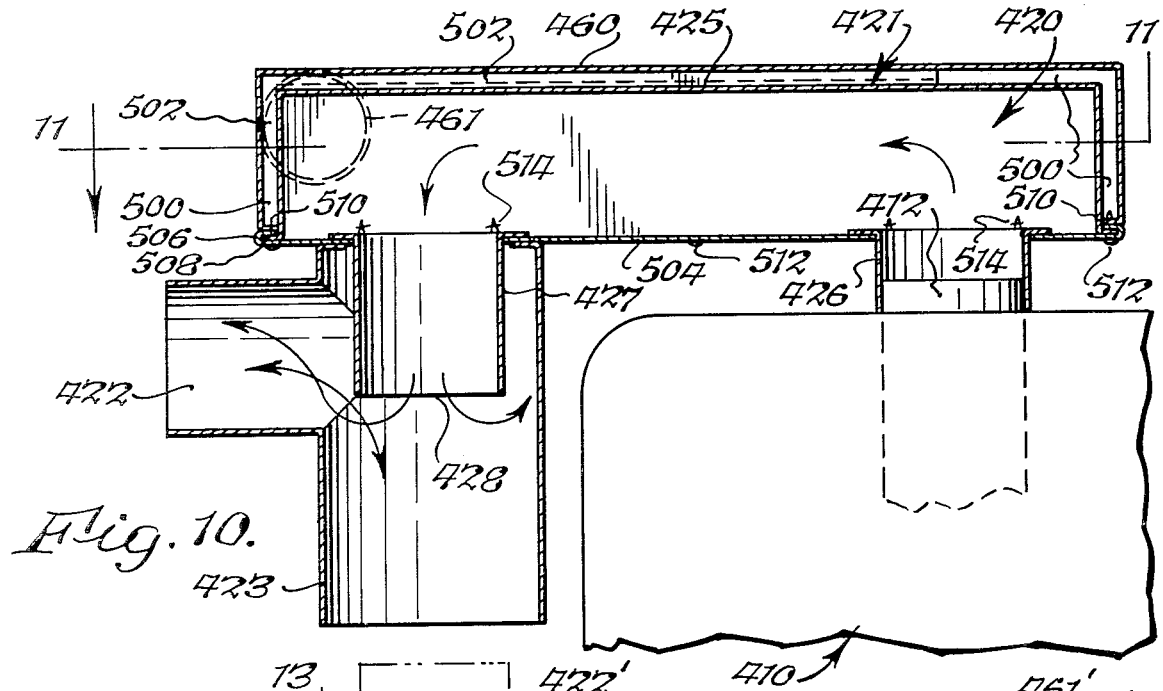
FIG. 10 is a further modified construction and is a vertical section taken along line 10—10 of FIG. 11.
Figure 11:
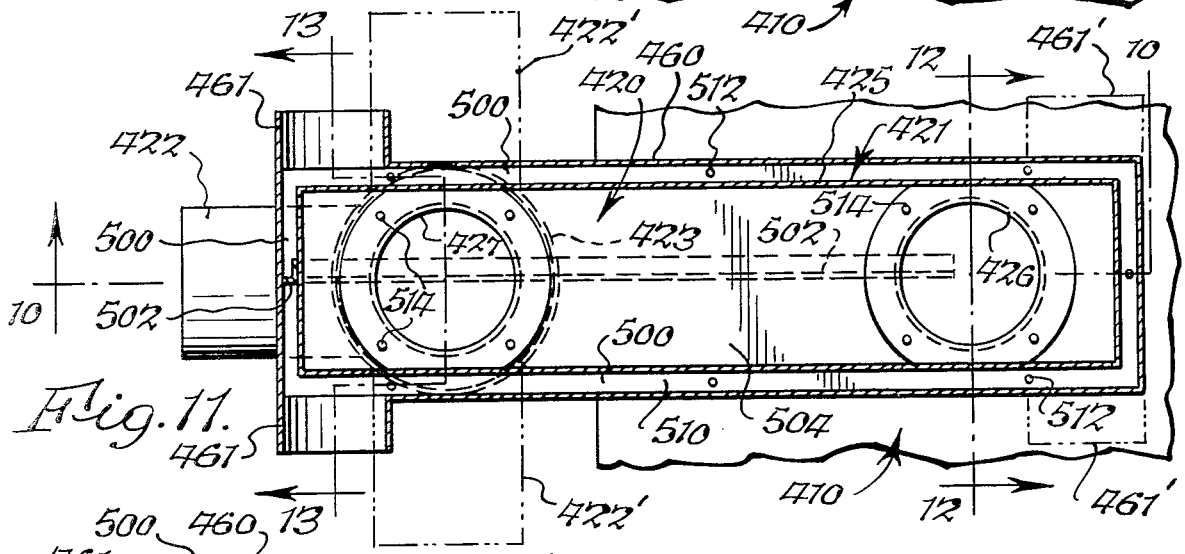
FIG. 11 is a horizontal sectional view taken along line 11—11 of FIG. 10 and FIGS. 12 and 13 are vertical sectional views taken along corresponding lines in FIG. 11.
Figure 12:
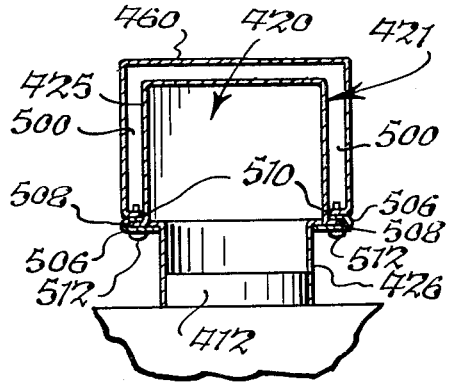

A further improved form of the invention shown in FIGS. 10–12 has features that facilitate the installation of the trap to many variable conditions confronted in the field of use. Some variables are, the position of chimney connection both in horizontal and vertical directions as well as the connection to a cold air return.

As shown in FIGS. 10–12 all similar parts previously described include the prefix 4. A housing 460 encloses a gas trap 420 which comprises a U-shaped assembly 421 having a horizontal leg 425, a heater connection 426 and a chimney leg 427. The housing 460 completely surrounds the horizontal leg 425 except for its bottom base wall 504. An air space 500 between the housing 460 and the leg 425 has access to a pair of opposed nipples 461, which are separated, communication wise by a baffle 502. Either one or the other of the nipples 461 may be connected to the air return duct such as 51, shown in FIG. 6. Since both nipples are at opposite sides, but at one end of the housing 460, a choice can be made for the most desirable direct connection to a duct 51 by either one of the nipples 461 as shown clearly in FIGS. 11 and 13. If the installation is such that the connection is to the right in FIG. 11, the housing 460 can be placed on the horizontal duct 425 with the nipples 461 to the right as shown in dash double dot lines 461'. Thus it can be as in full lines 461 or in the dash lines 461' of FIG. 11. This makes possible, four different orientations of connection to the nipples as well as the additional possibility of swiveling the trap 421 with the housing 460 about the center axis of connection 426 in a horizontal direction. Either nipple 461 may be connected to the duct 51 since room air will then enter into the air space 500 through the unconnected nipple and air will flow all over the horizontal duct 425 because of the baffle 502 making it travel completely around it. Also the unconnected nipple 461 could be piped to a remote source of air, outside fresh air for example.

The horizontal duct 425 comprises an inverted pan resting upon a base plate 504 which has an inwardly bent over portion 506 which enfolds an outwardly extending periferal flange portion 508 formed on the vertical walls of the pan shaped duct 425. Housing 460 also has an inwardly bent periferal flange 510 which rests upon the periferal portion 506 and may be fastened by sheet metal screws 512 or equivalent fasteners. The heater connection 426 and the chimney leg 427 extend downwardly from the base plate 504 and may be fastened thereto as is usual in sheet metal craftsmanship or by screw fasteners 514.

In this form the shroud part 423 takes the form of a pipe T which also includes the chimney connections 422 and in this instance is horizontally disposed, instead of vertically as were the chimney connections 22, 122, 222, and 322 in the previous forms. This arrangement makes possible a connection to the chimney at a lower elevation than could be made directly to the flue 412 of a heater 410 by an ordinary elbow. The advantage here is in installations where height is at a premium, since all flue pipes should be graded upwardly to the chimney for good flow of gasses.

Figure 13:
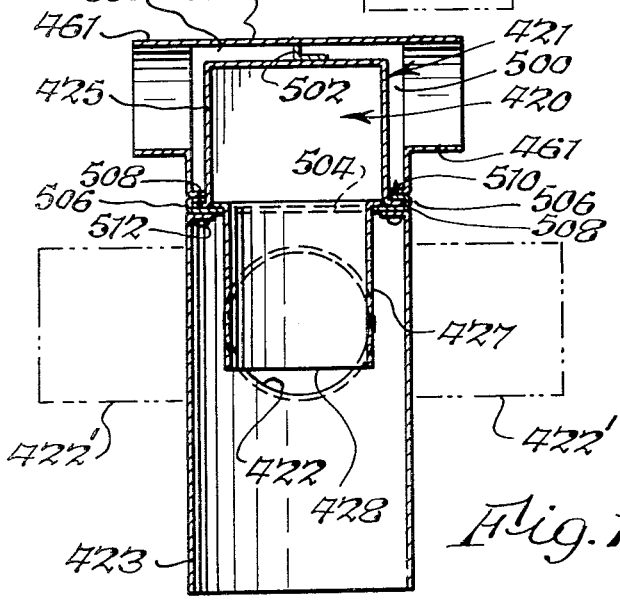

A further advantage gained with the T-shaped shroud 423, is that it can be swiveled about its vertical axis for more convenient directional access, for piping to a chimney. The dash double dot lines 422 in FIGS. 11 and 13 illustrate the rotation of the chimney connection 422' 90° in either direction from the full line position of 422. The fastening means 514 if used are removed, the part is then rotated to the position desired and the fasteners replaced. It should now be clear that this form of the invention is most versatile in orientation to fit the needs of a particular installation for both connection to a chimney and an air return duct, while at the same time providing a lower head room installation of piping to a chimney for good gravity flow.

As shown in FIG. 10 the lower end 428 of the chimney leg 427 extends down below the heater flue connection 426 to give a choking head of $H^2$ as seen in FIG. 1. To make adjustment in this form, an increase in choke effect would necessitate a shortening of the duct 426 while a decrease in choke effect would require the lengthening of 426 by the insertion of a length of pipe between duct 426 and the appliance flue 412.

In an example such as a hot water heater like that shown in FIG. 2, where the thermostat has turned the burner to an OFF condition, the typical temperature of air and gas at $t^1$ in the trap 20 at its hottest point would be around 100°, just about 35° above an ambient room temperature of 65°. This 100° represents the temperature of air warmed by convection from the walls of the flue 12 which has transfered heat from the hot water stored in the tank 11 to the air and it also includes the heat from combustion gasses of the pilot flame. Very little warm air is being lost up the chimney 31 because the trap 20 has choked off the flow of gasses and its temperature $t^2$ is at the ambient room temperature of 65°.

When the hot water heater burner 14 is turned ON by the thermostat as shown in FIG. 1 the temperature $T^1$ in the trap 20 goes up to approximately 500° while the temperature in the chimney connection 22 goes up to approximately 375°. The chimney connection 22 is now carrying a free flow of hot flue gasses from the heater as well as a portion of ambient room air at 65° and thus the 375° temperature is below the 500° trap temperature gas. Also the trap assembly 20 is now hot and losing heat by radiation as well as losing heat through convectional heating of the room air as well.

In the hot air furnace 210 illustrated in FIG. 6 an example of temperatures when in ON condition could be as follows. The trap 220 temperature $T^1$ might be 390° while the stack 222 temperature $T^2$ might be 130°. This form of the invention which has the housing 260 enclosing the larger portion of the trap 220, guides a flow of ambient air into the furnace cold air return 51 at the temperature $T^3$ of approximately 140°. This warmed air $T^3$ is heated room air from space 30, saved from loss at the heater and put back into the heater circulating system. At the same time, the temperature of flue gas going up the chimney, has been lowered meaning that heat has been retained from loss up the chimney. Further a lower chimney temperature helps diminish the tendency of the chimney to remove warmed air from the space 30.

As illustrated in FIG. 6 in the dash lines indicated as 223' this shroud portion 223' may be extended toward the floor of the space 30 if desired, where the ambient air temperature would be much lower than at the level of the open bottom of 223 shown in full, lines in FIG. 6. This extended shroud 223' would further reduce the continuous heat loss up the chimney.

With the vertical adjustability of the ducts 122 and 322 these forms of the invention can be custom fitted to each heater installed on, to increase their heating efficiency as well as to conserve the heat delivered to them.

From the foregoing it will be apparent that the constructions just described function to accomplish fully the objects set forth in a reliable and fool-proof manner and can easily be used with present heaters to conserve heat energy.

The terms and expressions which have been employed are used as terms of description and not of limitation, and there is no intention, in the use of such terms and expressions, of excluding any equivalents of the features shown and described, or portions thereof, it being recognized that various modifications are possible within the scope of the invention claimed.

What is claimed is:

1. A discrete hot gas trap attachment for connection between the outlet flue of a heater in an environ space and a chimney to either vent hot flowing gases freely from said outlet flue to said chimney or to choke hot passive gases from said outlet flue to said chimney comprising an elongated horizontal housing including a base plate and a top plate connected to each other by sidewalls for defining a horizontal choke chamber, a heater connection duct depending from the lower side of said base plate for connection to said outlet flue, a chimney leg duct and a shroud portion depending from said base plate and being positioned in laterally spaced relationship to said heater connection duct, said shroud portion extending below said chimney leg duct with said shroud portion being in vertical alignment with said chimney leg duct, said shroud portion and said chimney leg duct being open to said environ space, and a chimney connection duct having its vent opening at or below said base plate and in communication with both said chimney leg duct and said shroud portion for venting said outlet flue to said chimney to vent hot flowing gases freely or for venting said environ space to said chimney to choke hot passive gases from said outlet flue.

2. A hot gas trap as in claim 1 wherein, said shroud surrounds said chimney leg duct.

3. A hot gas trap as in claim 1 wherein, said chimney connection duct passes through said top wall of said horizontal choke chamber and down into said chimney leg and said shroud portion.

4. A hot gas trap as in claim 1 further comprising, a rotatable mounting of said shroud part on said base plate to allow it to swivel about its vertical axis.

5. A hot gas trap as in claim 1 further comprising; a housing enclosing said horizontal choke chamber but spaced therefrom to provide an air space blanket to thermally insulate the walls of said horizontal choke chamber from the ambient air in said environ space.

6. A hot gas trap as in claim 5 further comprising; said housing having an air inlet at one location and an air outlet at another location in its walls whereby ambient environ air may enter said air space to transfer heated air from said space to said air outlet and out to a source lower in air pressure than that of said ambient environ air.

7. A hot gas trap as in claim 1 wherein, said horizontal choke chamber is comprised of an inverted pan part closed by said base plate, with their peripheral edges fastened together in a sealed relationship.

8. A hot gas trap as in claim 7 wherein said first mentioned inverted pan part is covered by a second pan part of similar shape and fastened to said first pan part along its periphery to provide an insulating air space between said first pan part and said similar pan part.

9. A hot gas trap as in claim 8 wherein said second pan part is provided with an air inlet and an air outlet.

* * * * *